US005692249A

United States Patent [19]

Johnson

[11] Patent Number: 5,692,249

[45] Date of Patent: Dec. 2, 1997

[54] TOP MOUNTED FLUSH VALVE

[76] Inventor: Dwight N. Johnson, 6327 Chorlito Dr., Carlsbad, Calif. 92008

[21] Appl. No.: 664,922

[22] Filed: Jun. 18, 1996

[51] Int. Cl.[6] ..... E03D 1/34

[52] U.S. Cl. ..... 4/378; 285/39

[58] Field of Search ..... 4/378, 417, 418; 285/39, 162, 205

[56] References Cited

U.S. PATENT DOCUMENTS

| | | | |
|---|---|---|---|
| 3,136,203 | 6/1964 | Davis | 85/40 |
| 3,348,444 | 10/1967 | Brignola | 85/70 |
| 3,879,065 | 4/1975 | Kobayashi | 285/39 |
| 4,191,409 | 3/1980 | Ballantyne | 285/162 X |
| 4,576,400 | 3/1986 | Allred et al. | 285/162 X |

OTHER PUBLICATIONS

Emhart, POP Fastening Systems Group, "Well-Nuts" Threaded Inserts Brochure.

*Primary Examiner*—Charles E. Phillips

*Attorney, Agent, or Firm*—Mason, Kolehmainen, Rathburn & Wyss

[57] ABSTRACT

A top mounted flush valve is installed from inside a flush tank and does not require access to the opposite tank wall. A valve body includes an annular chamber receiving a radially enlarged head portion of a flexible resilient seal member. A draw ring is fixed to the remote end of a barrel portion of the seal member. A draw collar has a flange bearing against the body and a cylindrical portion threaded to the draw ring. Rotation of the draw collar outwardly collapses the seal barrel portion, and a seal bead on the seal member head is forced against the inner tank surface. A wall of the body isolates the draw collar from the seal barrel, and the enlarged head portion is wedged into the annular chamber to prevent rotation of the seal member.

15 Claims, 2 Drawing Sheets

TOP MOUNTED FLUSH VALVE

FIELD OF THE INVENTION

The present invention relates to fluid devices, such as a top mounted flush valve, adapted to be mounted to a wall of a container, such as a flush tank, where only a single side of the container wall is accessible.

DESCRIPTION OF THE PRIOR ART

In many applications fluid devices such as valves are mounted in a wall of a tank or container to permit fluid to flow into or out of the container. In a typical installation, for example, a threaded shank of a body such as a valve body can extend through an opening in the container wall, and a threaded nut can be applied at the opposite side of the container wall. However, there are many instances when there is no convenient access to both sides of a container wall. In these applications, there is a need for a mounting system that permits attaching the fluid device opening from only one side of the container wall. One example is a flush valve mounted in the flush tank of a one piece toilet where the only access to the mounting region is inside the flush tank.

The conventional way to mount a top mounted flush valve is to use a system including screw fasteners extending through the throat of the flush valve. The screws engage a spanner or a series of tabs that are drawn up against the outer, inaccessible surface of the tank wall. A washer between the tank wall surface and a flange on the valve body is compressed to form a seal. This known system has disadvantages including cost, the need for many discrete parts, obstruction of the flow path by the mounting hardware and the potential for interference with a flapper valve member mounted on the flush valve body.

It has been proposed to mount various members to walls using a resilient deformable seal or collar which is inserted from one side through an opening and then outwardly collapsed. Typically a threaded draw member or screw is rotated to draw the remote end of a flexible seal member toward the wall. A problem with these known devices is that rotational forces can be transferred from the rotating draw member to the seal. If the seal rotates, it is not drawn into the desired mounting position. Various inconvenient and unreliable expedients have been proposed to prevent the seal from rotating when the draw member is rotated.

U.S. Pat. No. 3,136,203 discloses a blind rivet including a bolt 15 having a shank threaded into a threaded section 25 of a case 16. When the bolt is rotated, the case is compressed and expands radially to form a locking ring 30. The case has an undercut intermediate portion 24. To prevent rotation of the case when the bolt is rotated, the case is held by a tool engaged with slots 22 in a head portion of the case.

U.S. Pat. No. 3,348,444 discloses an expansion fastener including a resilient member 16 and a screw 36 threaded into nuts 28 and 30 received in recesses in the resilient member. A recess 27 assists in starting the collapse and outward bulging of a barrel portion of the resilient member when the screw 36 is rotated relative to the resilient member. A large flange 20 of the resilient member is clamped between a support panel 14 and an attached article 12 and is intended to hold the resilient member against rotation when the screw is rotated. Sufficient axial force must be applied to the flange to achieve this result.

U.S. Pat. No. 3,879,065 discloses couplings for sanitary appliances in which a flexible cylindrical body is elastically expanded to mount the coupling to an opening in a wall of the appliance. A main body is threaded into a ring fixed to the lower portion of the flexible body and the main body is rotated to diametrically inflate the flexible body. Frictional contact is intended to prevent rotation of the flexible body (see column 5, lines 41–46 and FIGS. 3–5). Alternatively a tool is used to hold the flexible member stationary while the main body is rotated (see column 31–37 and FIGS. 6–10B).

SUMMARY OF THE INVENTION

A principal object of the present invention is to provide an improved fluid device, for example a tank mounted flush valve, that is mounted to a container wall from one side of the wall. Other objects are to provide a fluid device in which rotational forces from a rotating draw member used to draw the seal into a mounted position are isolated from the seal assembly; to provide a device in which the frictional torque applied to the seal assembly is limited to frictional engagement of the draw threads; to provide a device in which the seal assembly is dynamically restrained against rotation without relying on axial forces externally applied to the seal assembly; and to provide a tank mounted flush valve or other fluid device overcoming problems with devices of the prior art.

In brief, in accordance with the invention there is provided a flow device such as a top mounted flush valve adapted to be mounted in a container wall opening against a container wall surface. The flow device has a body defining a segment of a flow path extending in an axial direction through the container wall opening when the flow device is mounted. The body includes radially spaced inner and outer cylindrical walls and an annular base wall, the inner and outer and base walls defining an annular channel having an open side facing in a first axial direction toward the container wall surface when the flow device is mounted. The body defines a bearing surface facing in a second axial direction opposed to the first axial direction. A seal assembly includes a flexible resilient member having a radially enlarged head portion captured in the annular channel and a cylindrical barrel portion extending from the head portion in the first axial direction. The seal assembly includes a threaded draw ring fixed to the end of the barrel portion remote from the head portion. A draw collar defines an additional segment of the flow path and has a cylindrical portion rotatably received within the barrel portion and extending between the bearing surface and the draw ring. The collar has a radially outwardly extending bearing flange engaging the bearing surface and the cylindrical portion has threads mating with the threaded draw ring for drawing the draw ring toward the body and for deforming the flexible resilient member and radially outwardly collapsing the barrel portion against the container wall in response to rotation of the draw collar.

BRIEF DESCRIPTION OF THE DRAWING

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
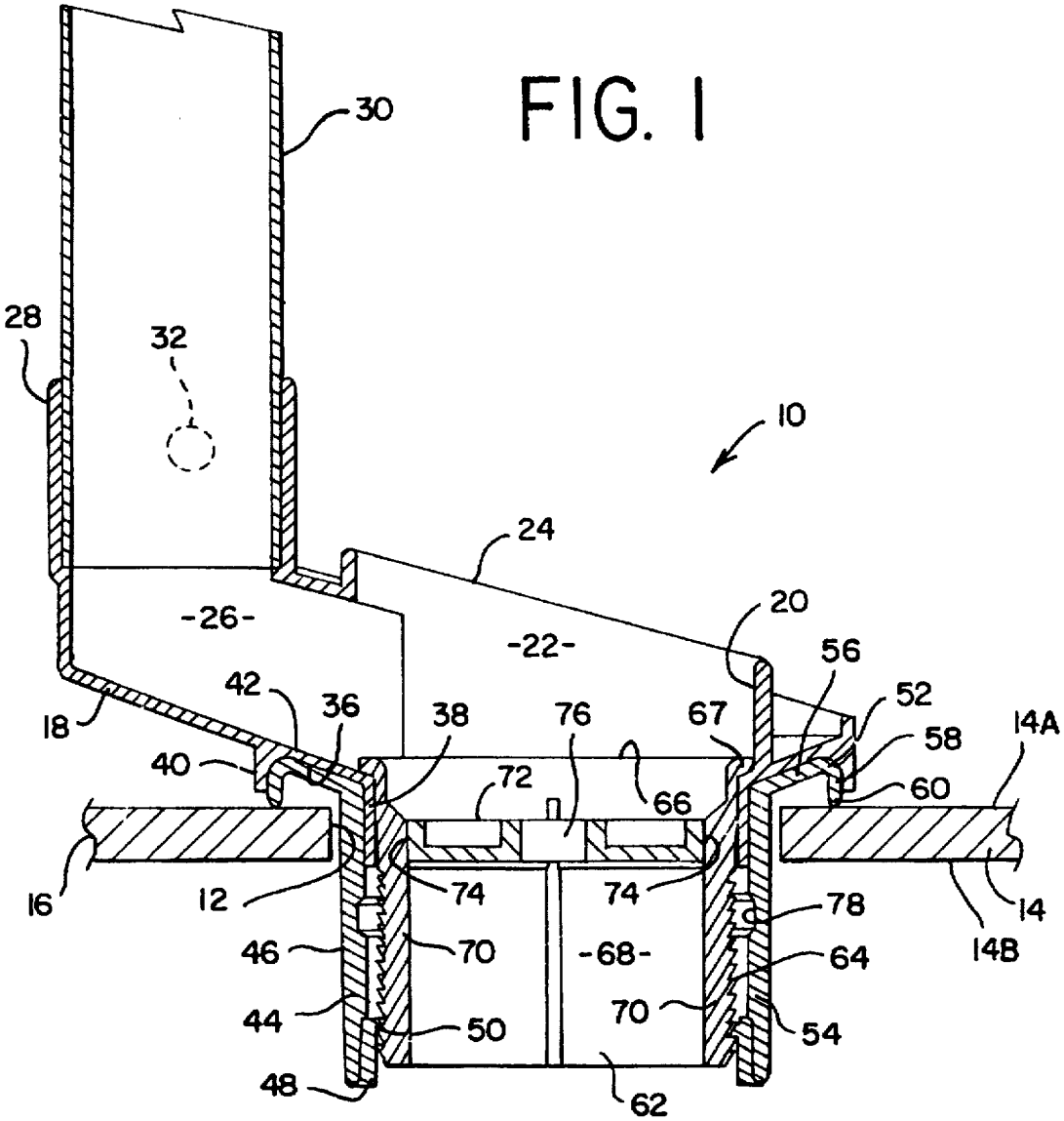
FIG. 1 is a sectional view of a top mounted flush valve embodying the present invention, taken along the axis of the flow path through the valve, and illustrating the valve prior to mounting the valve to a tank wall.
Figure 2:
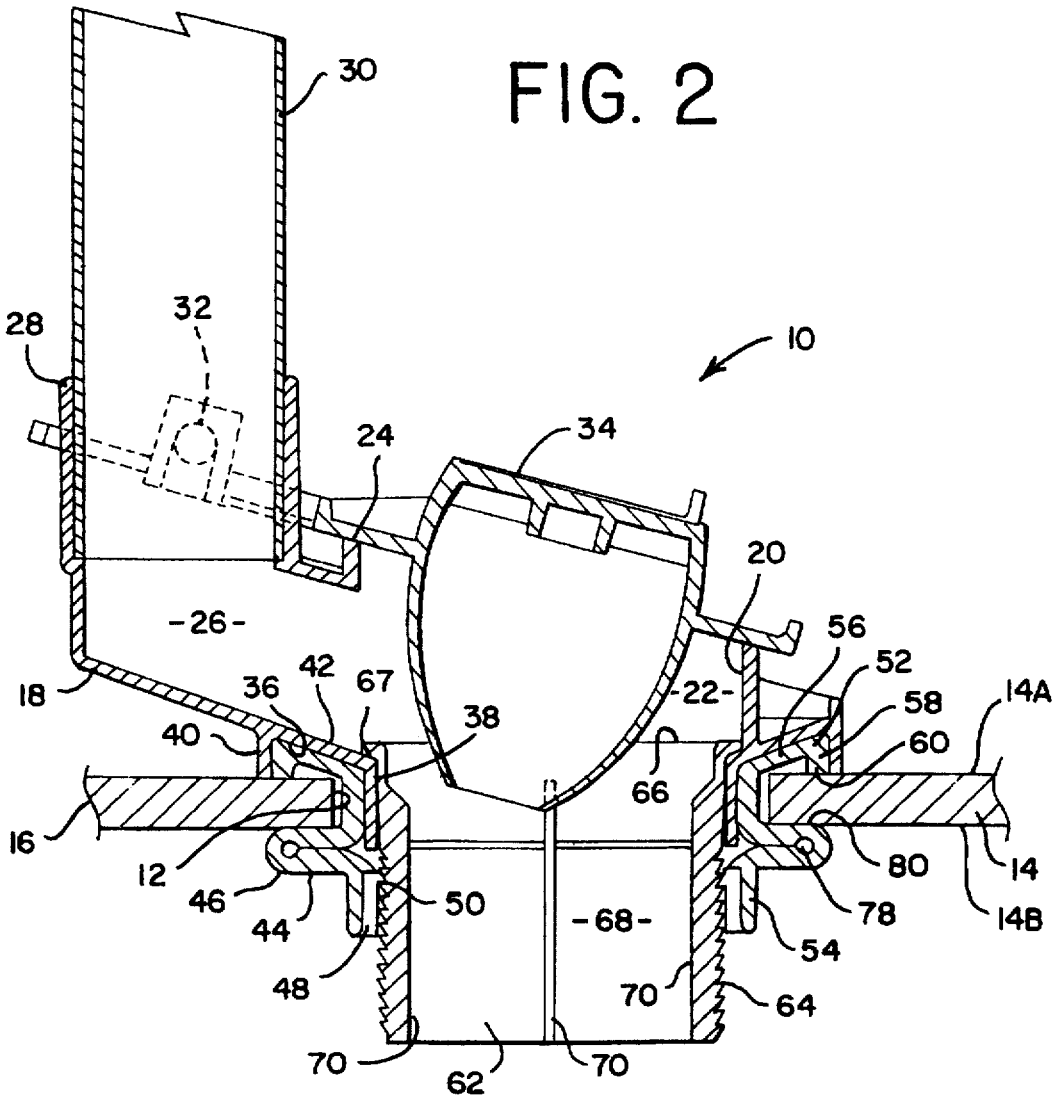
FIG. 2 is a view similar to FIG. 1 illustrating the assembled valve mounted in place on the bottom wall of a flush tank.

Having reference now to the drawings, in FIG. 1 there is illustrated a top mounted flush valve generally designated as 10 and constructed in accordance with the principles of the present invention. The valve 10 is adapted to be mounted in an opening 12 in the bottom wall 14 of a toilet flush tank 16, a portion of which is seen in FIGS. 1 and 2. The tank 16 is part of a one piece toilet. From the tank interior, access may be had to the interior tank wall surface 14A, but there is no access to the exterior tank wall surface 14B. Thus the valve 10 must be mounted from a single side of the wall 14 at the interior of the tank.

Valve 10 includes a molded plastic valve body 18 having a generally cylindrical wall section 20 defining the upper segment 22 of a flow passageway extending through the valve 10. The flow segment 22 terminates at a valve seat 24 within the tank 16. A lateral passage 26 extends to a collar 28 receiving a toilet overflow tube 30. Mounting studs 32 extend from the collar 28 for supporting a flush or flapper valve member 34 (FIG. 2) that cooperates with the valve seat 24 in a conventional manner for controlling flow through the valve 10.

An annular chamber or channel 36 is defined between an inner circular wall 38 and a coaxial outer circular wall 40. An annular base wall 42 extends between walls 38 and 40 and closes one side of the chamber 36. The opposite side of chamber 36 is open, and faces toward the inner tank wall surface 14A.

A seal assembly 44 includes a molded flexible resilient seal body 46 and a relatively rigid molded plastic draw ring 48 having an internal thread structure 50. A radially enlarged head portion 52 of the body 46 is captured within the annular chamber 36. The body 46 also includes a cylindrical barrel portion 54 that extends through the opening 12 when the valve 10 is placed in position for mounting as seen in FIG. 1. The draw ring 48 is fixed to the remote end of the barrel portion 52. In the preferred embodiment of the invention, the draw ring 48 is pre-molded of polypropylene and the body 46 is molded of a blend of polypropylene and ethylene-polypropylene rubber. When the body 46 is injection molded over the ring 48, an intermolecular bond firmly joins the ring 48 and the body 46.

The head portion 52 includes a radially extending flange portion 56 that overlies the annular base wall 42 of the chamber 36. An axially extending flange 58 extends from the outer diameter of the flange portion 56 within the outer wall 40. A tapered seal bead 60 is formed at the end of the axially extending flange 58. Before the valve is mounted to the wall 14, the seal bead 60 projects beyond the end of the outer wall 40.

A cylindrical draw collar 62 is rotatably received within the barrel portion 54 and has threads 64 engaged with the thread structure 50 of the draw ring 48. At its upper end, the draw collar 62 has a radially outwardly extending bearing flange 66 that bears against a body bearing surface 67 formed on the surface of annular wall 42 opposite to the chamber 36. The cylindrical portion of draw collar 62 defines a lower segment 68 of the flow path through the valve 10, and includes a plurality of axially extending tool engagement fins 70.

In order to mount the flush valve 10 in the tank 16, the valve 10 is first positioned as seen in FIG. 1 with the valve body 18 in the tank 16 and the draw collar 62 and the barrel portion 54 of the seal body 46 extending through the opening 12. With the seal bead 60 lightly contacting the wall 14, the outer chamber wall 40 is spaced from the surface 14A.

Figure 4:
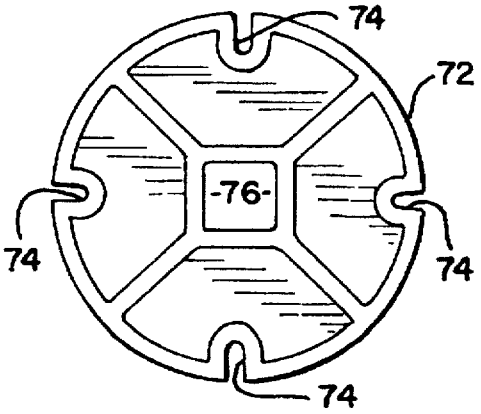
FIG. 4 is a top view of a tool used to mount the valve.
Figure 3:
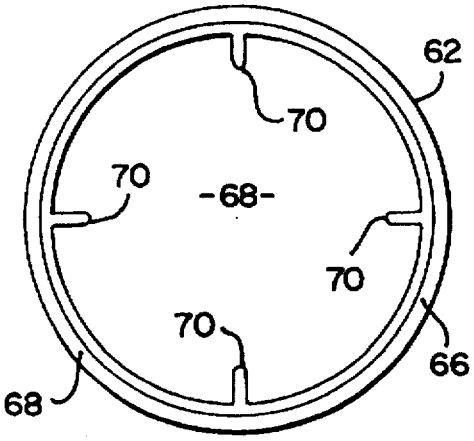
FIG. 3 is a top view of the draw collar of the valve.

An installation tool 72 is seen in FIGS. 1 and 4. It includes a plurality of slots 74 that mate with the fins 70 of the draw collar 62. A central drive hole 76 receives a suitable driver of complementary shape to rotate the tool 72 and the draw collar 62. The bearing flange 66 engages the bearing surface 67 and prevents axial movement of the draw collar 62. Rotation of the draw collar 62 draws the draw ring 48 toward the body 18 due to engagement of threads 64 with the thread structure 50.

The inner chamber wall 38 of the body 18 extends around the draw collar 62 from the bearing flange 66 substantially to the threads 64. The wall 38 is received within the barrel portion 54 of the seal body 46. As a result, the wall 38 separates and isolates the draw collar from the seal assembly, preventing the transfer of rotational forces from the rotating draw collar to the seal body 46. The only rotational torque applied to the seal assembly is that which necessarily results from the threaded engagement of the draw ring 48 with the draw collar 62.

As the draw ring is forced upwardly, the barrel portion 54 collapses radially outwardly. A groove 78 is formed in the inner surface of the barrel portion 54 (FIG. 1). The undercut groove 78 localizes the compressive stress to control the location of barrel deformation and to reduce the axial force required to deform the seal body 46.

As the seal body 46 is deformed, the axially directed reaction force applied from the draw collar 62 to the valve body 18 through the bearing flange-bearing surface interface 66–67 forces the valve body 18 toward the wall 14. The seal bead 60 compresses due to engagement with the inner tank wall surface 14A. The material of the head portion 52 of the seal body 46 is wedged or jammed up into the annular chamber 36, dynamically locking the seal body 46 against rotation. The annular base wall 42 and the radially extending flange 56 are sloped or conical in shape to provide a capture region included within an acute angle to augment this locking action. As can be seen in FIG. 1, clearance at the intersection of walls 40 and 42 provides a space into which material of the seal body 46 is jammed to achieve the dynamic locking effect.

The outer chamber wall 40 is drawn into contact with the inner tank surface 14A. This limits the force applied to the seal bead 60 and thus the deformation of the enlarged head portion 52 of the seal body 46. In addition, engagement of the wall 40 against the tank results in firm positioning of the valve 10 in the tank, even if the tank wall is rough and uneven.

In the installed position seen in FIG. 2, the seal body barrel portion 54 is outwardly deformed into a mounting flange 80 radially terminating in the region of the groove 78. The flange 80 firmly engages the outer wall surface 14B to hold the valve 10 in position. The tapered seal bead 60 is compressed into reliable, compliant sealing relation with the inner tank wall 14A. Flow through the flow segments 22 and 68 is relatively unimpeded.

Figure 5:
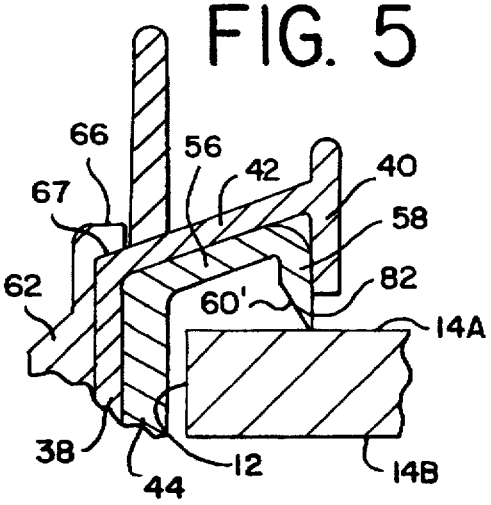
FIG. 5 is an enlarged, fragmentary sectional view of an alternative configuration of the seal bead of the seal assembly of the valve.
Figure 6:
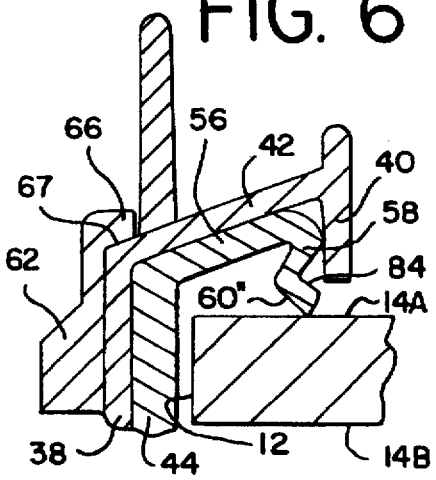
FIG. 6 is an enlarged, fragmentary sectional view of another alternative configuration of the seal bead of the seal assembly of the valve.

An alternative seal bead configuration 60' is seen in FIG. 5. In this arrangement, the bead 60' has a fairly sharp, knife-like edge 82 at the outer periphery of the head portion 52. Another alternative seal bead configuration 60Δ is shown in FIG. 6. This configuration includes an annular corrugation providing a groove 84. These alternative configurations are intended to provide compliance to a rough tank wall surface and to achieve reliable sealing.

While the present invention has been described with reference to the details of the embodiments of the invention shown in the drawing, these details are not intended to limit the scope of the invention as claimed in the appended claims.

What is claimed is:

1. A flow device adapted to be mounted in a container wall opening against a container wall surface, said flow device comprising:

a body defining a segment of a flow path extending in an axial direction through the container wall opening when the flow device is mounted;

said body including radially spaced inner and outer cylindrical walls and an annular base wall, said inner and outer and base walls defining an annular channel having an open side facing in a first axial direction toward the container wall surface when the flow device is mounted;

said body defining a bearing surface facing in a second axial direction opposed to said first axial direction;

a seal assembly including a flexible resilient member having a radially enlarged head portion captured in said annular channel and having a cylindrical barrel portion extending from said head portion in said first axial direction;

said seal assembly including a threaded draw ring fixed to the end of said barrel portion remote from said head portion; and a draw collar defining an additional segment of said flow path and having a cylindrical portion rotatably received within said barrel portion and extending between said bearing surface and said draw ring;

said collar having a radially outwardly extending bearing flange engaging said bearing surface and said cylindrical portion having threads mating with said threaded draw ring for drawing said draw ring toward said body and for deforming said flexible resilient member and radially outwardly collapsing said barrel portion against the container wall in response to rotation of said draw collar.

2. A flow device as claimed in claim 1, said body including a valve seat surrounding said flow path, and a valve member movably mounted on said body for controlling flow through said valve seat.

3. A flow device as claimed in claim 1, said radially inner wall being cylindrical and extending in said first axial direction between said barrel portion of said seal assembly and said cylindrical portion of said draw collar for preventing transfer or rotational force from said draw collar to said seal assembly.

4. A flow device as claimed in claim 1, said body bearing surface being defined on a surface of said annular base wall opposite said annular channel.

5. A flow device as claimed in claim 1, said annular base wall being a truncated cone sloped relative to said axial directions.

6. A flow device as claimed in claim 1, said radially enlarged head portion of said flexible resilient member having a sealing bead projecting in said first axial direction beyond said radially outer wall toward the container wall surface before deformation of said flexible resilient member.

7. A flow device as claimed in claim 6, said sealing bead tapering to a knife-like edge.

8. A flow device as claimed in claim 6, further comprising an annular groove in said flexible resilient member separating said sealing bead from the remainder of said radially enlarged head portion.

9. A flow device as claimed in claim 6, said sealing bead being sized to permit said radially outer cylindrical wall to move into contact with the container wall surface as said flexible resilient member is deformed.

10. A flow device as claimed in claim 6, said radially enlarged portion including an annular section overlying said annular base wall of said body and an axially extending flange portion extending from said annular portion to said sealing bead and overlying said radially outer cylindrical wall.

11. A flow device as claimed in claim 10, said annular section and said annular base wall being conical.

12. A flow device as claimed in claim 11, the intersection of said annular section and said flange portion having a chamfer like shape defining a space within said annular channel where said radially enlarged portion is wedged when said flexible resilient member is deformed.

13. A flow device as claimed in claim 1, said draw collar including a tool engagement structure formed within said cylindrical portion.

14. A valve for mounting in a mounting opening in a wall of a container, said valve comprising:

a body defining a flow path and a valve seat surrounding said flow path;

valve means cooperating with said seat for controlling flow along said flow path;

a mounting system projecting from said body and adapted to be inserted into the mounting opening from a first side of the wall, said mounting system including a seal assembly and a draw collar cooperating with said body for outwardly collapsing said seal assembly in response to rotation of said draw collar relative to said body;

said seal assembly including a cylindrical flexible seal member and a rigid, threaded draw ring secured to a first end of said seal member remote from said body;

said draw collar having a cylindrical threaded wall concentric with and disposed within said seal member, said threaded wall being threaded into said threaded draw ring for axially drawing said draw ring toward said body in response to rotation of said draw collar;

said valve being characterized by:

said seal assembly including a seal flange integral with said seal member and extending radially outward from the end of said seal member opposite said draw ring; and said body including walls defining an annular seal capture chamber confining said seal flange in radially inward and radially outward and axial directions.

15. A valve for mounting in a mounting opening in a wall of a container, said valve comprising:

a body defining a flow path and a valve seat surrounding said flow path;

valve means cooperating with said seat for controlling flow along said flow path;

a mounting system projecting from said body and adapted to be inserted into the mounting opening from a first side of the wall, said mounting system including a seal assembly and a draw collar cooperating with said body for outwardly collapsing said seal assembly in response to rotation of said draw collar relative to said body;

said seal assembly including a cylindrical flexible seal member and a rigid, threaded draw ring secured to a first end of said seal member remote from said body;

said draw collar having a cylindrical threaded wall concentric with and disposed within said seal member, said threaded wall being threaded into said threaded draw ring for axially drawing said draw ring toward said body in response to rotation of said draw collar;

said valve being characterized by:

said body including a bearing surface and said draw collar having a bearing flange engaging said bearing surface for preventing axial movement of said draw collar; and said valve body having a cylindrical separator wall extending from a second end of said seal member between said seal member and said draw collar for preventing the transfer of rotational force from said draw collar to said seal member.

* * * * *